US005174505A

United States Patent [19]

Shen

[11] Patent Number: 5,174,505

[45] Date of Patent: Dec. 29, 1992

[54] AIR ASSIST ATOMIZER FOR FUEL INJECTOR

[75] Inventor: Jingming J. Shen, Newport News, Va.

[73] Assignee: Siemens Automotive L.P., Auburn Hills, Mich.

[21] Appl. No.: 786,471

[22] Filed: Nov. 1, 1991

[51] Int. Cl.[5] ..... B05B 7/12; B05B 1/30

[52] U.S. Cl. ..... 239/417.3; 239/408; 239/424; 239/428.5; 239/585.1; 239/590; 239/590.5; 123/531

[58] Field of Search ..... 239/408, 416.5, 417.3, 239/424, 424.5, 596, 533.12, 585.1, 585.1, 585.5, 428.5, 590, 590.5; 123/531, 533; 137/892

[56] References Cited

U.S. PATENT DOCUMENTS

| | | | |
|---|---|---|---|
| 2,551,276 | 5/1951 | McMaHan | 239/428.5 |
| 3,217,986 | 11/1965 | Davis, Sr. et al. | 239/428.5 |
| 3,656,693 | 4/1972 | Eckert | 239/424 |
| 4,434,766 | 3/1984 | Matsuoka et al. | 123/531 |
| 4,545,354 | 10/1985 | Jaggle et al. | 123/531 |
| 4,566,634 | 1/1986 | Wiegand | 239/533.12 |
| 4,903,898 | 2/1990 | Kind | 239/533.12 |
| 4,945,877 | 8/1990 | Ziegler et al. | 123/531 |
| 4,957,241 | 9/1990 | Roger | 239/585.1 |
| 4,982,716 | 1/1991 | Takeda et al. | 123/531 |
| 5,035,358 | 7/1991 | Katsuno et al. | 239/585.1 |

FOREIGN PATENT DOCUMENTS

| | | | |
|---|---|---|---|
| 0018452 | 1/1982 | Japan | 239/585.5 |

*Primary Examiner*—Andres Kashnikow
*Assistant Examiner*—Christopher G. Trainor
*Attorney, Agent, or Firm*—George L. Boller; Russel C. Wells

[57] ABSTRACT

The atomizer is a cap-shaped shroud that contains a flat stamped metal insert. When assembled onto the nozzle of a fuel injector, the atomizer causes the insert to be axially sandwiched between the shroud's end wall and the exterior end of the nozzle. In the zone of sandwiching, the insert has circumferential discontinuities that in cooperation with the nozzle end and the shroud's end wall define air assist openings for the assist air to flow radially inwardly toward the injected fuel that has just been injected from the nozzle.

24 Claims, 3 Drawing Sheets

AIR ASSIST ATOMIZER FOR FUEL INJECTOR

FIELD OF THE INVENTION

This invention relates generally to fuel injectors of the type that are used to inject liquid fuel into the air induction system of an internal combustion engine and particularly to an atomizer that fits over the nozzle of such a fuel injector and serves to convey assist air to promote the atomization of the injected liquid fuel that has just left the nozzle.

BACKGROUND AND SUMMARY OF THE INVENTION

Air assist atomization of the liquid fuel injected from the nozzle of a fuel injector is a known technique that is used to promote better preparation of the combustible air/fuel mixture that is introduced into the combustion chambers of an internal combustion engine. A better mixture preparation promotes both a cleaner and a more efficient combustion process, a desirable goal from the standpoint of both exhaust emissions and fuel economy.

The state of the art contains a substantial number of patents relating to air assist atomization technology. The technology recognizes the benefits that can be gained by the inclusion of special assist air passages that direct the assist air into interaction with the injected liquid fuel. Certain air assist fuel injection systems use pressurized air, from either a pump or some other source of pressurization, as the assist air. Other systems rely on the pressure differential that exists between the atmosphere and the engine's induction system during certain conditions of engine operation. It is a common technique to mount the fuel injectors in an engine manifold or fuel rail which is constructed to include assist air passages for delivering the assist air to the individual injectors.

It is known from commonly assigned U.S. Ser. No. 07/652,166 to construct an air assist atomizer in which the definition of the final length of the assist air passage to each fuel injector tip is provided by the cooperative organization and arrangement of two additional parts which form an atomizer assembly disposed between the nozzle of an injector and the wall of a socket that receives the injector. One advantage of that invention is that it adapts an otherwise conventional electrically-operated fuel injector for use in an air assist system without the need to make modifications to the basic injector, and without the need to make special accommodations in the injector-receiving socket other than suitably dimensioning the socket to accept the air assist atomizer.

The air assist atomizer of the present invention is similar to that of U.S. Ser. No. 07/652,166 in that it comprises the cooperative organization and arrangement of two individual parts; in other respects, as will become apparent from the ensuing description, drawings, and claims, it is distinguished from the air assist atomizer of U.S. Ser. No. 07/652,166.

From Patentschrift DE 40 04 897 C1 it is known to construct a one-piece atomizer with a series of short, circumferentially spaced apart risers on the interior of the atomizer's end wall which abut the end of the nozzle so as to thereby cooperatively define a number of circumferentially spaced apart air assist openings through which assist air passes radially to act upon the injected fuel just after it has left the nozzle. In order to create and to closely control the axial dimension of these air assist openings, it would seem essential to conduct precision machining operations on the interior of the end wall, and since the dimensions involved are small, it may be forecast that such machining operations will be difficult to conduct in a cost-effective manner for mass production of the atomizer.

The present invention is similar to the atomizer disclosed in Patentschrift DE 40 04 897 C1 and other earlier prior art in that it comprises a number of air assist openings that are circumferentially spaced apart and that convey assist air radially inwardly toward the injected fuel; it is distinguished however in that instead of risers, a separate disk is inserted into the interior of a surrounding shroud that is fitted over the nozzle. The disk is disposed axially sandwiched between, and in mutual abutment with, the nozzle and the end wall of the shroud to thereby create the air assist openings through which assist air is radially inwardly directed to the injected fuel that has just left the nozzle. The disk can be advantageously fabricated by conventional stamping technology, and the interior of the shroud can be finished without the ostensibly elaborate measures that may be expected in the case of the atomizer described in the referenced Patentschrift.

Further features, advantages, and benefits of the present invention will be seen in the ensuing description and claims which are accompanied by drawings. These drawings disclose a presently preferred embodiment of the invention according to the best mode contemplated at this time for carrying out the invention.

DESCRIPTION OF THE PREFERRED EMBODIMENT

Figure 1:
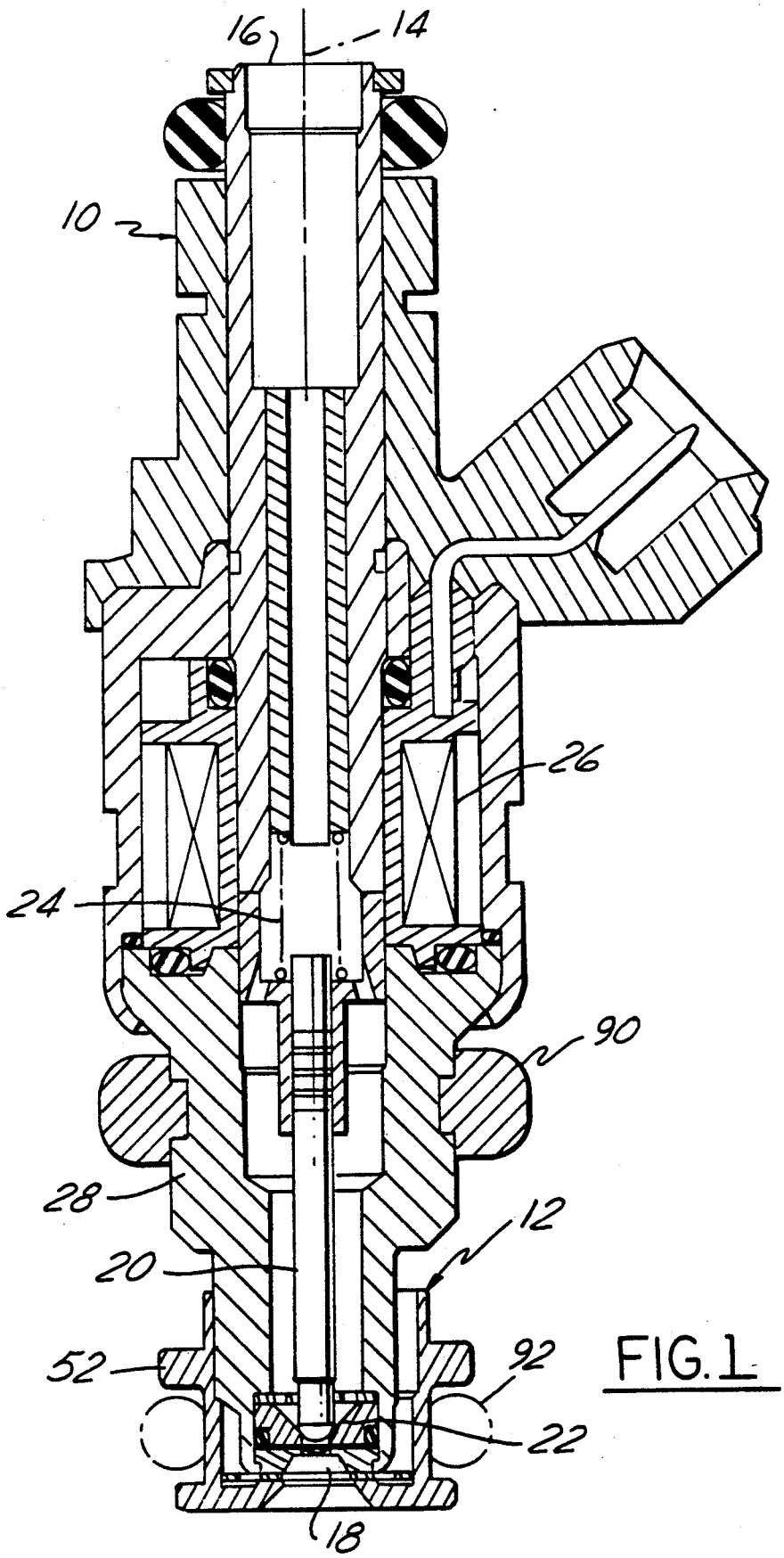
FIG. 1 is a longitudinal cross sectional view through a fuel injector containing an air assist atomizer in accordance with principles of the present invention.
Figure 2:
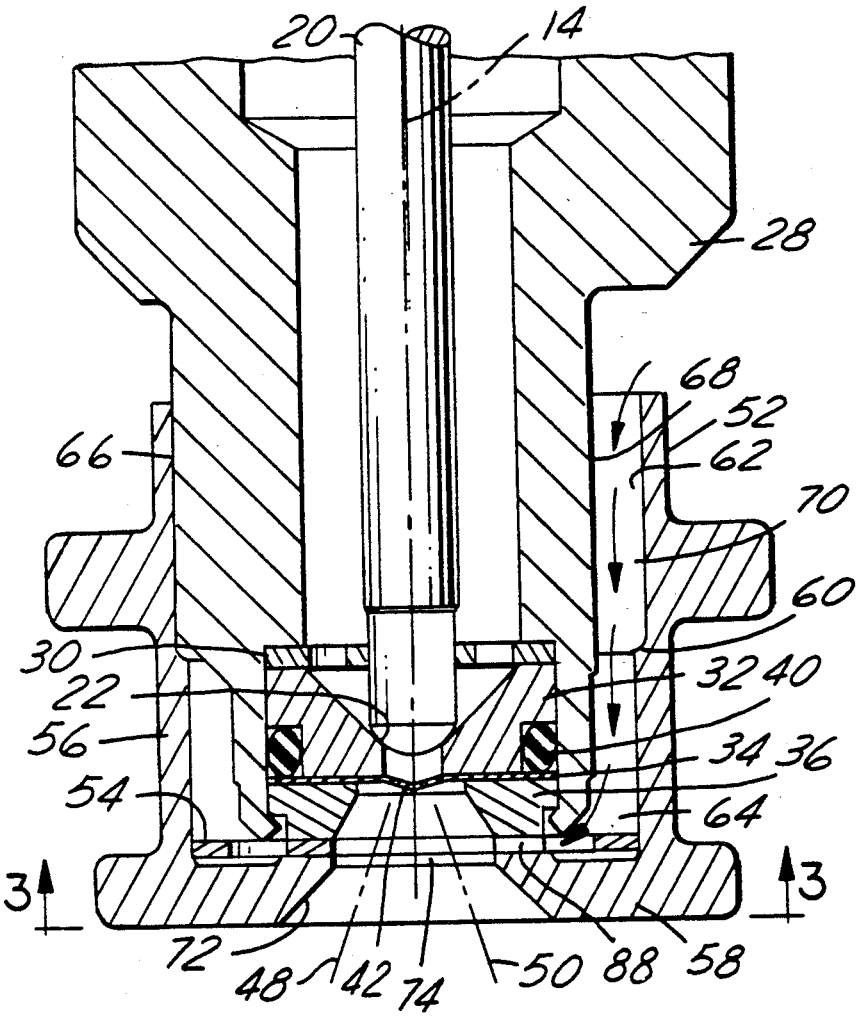
FIG. 2 is an enlarged view of the nozzle end of the fuel injector of FIG. 1.
Figure 3:
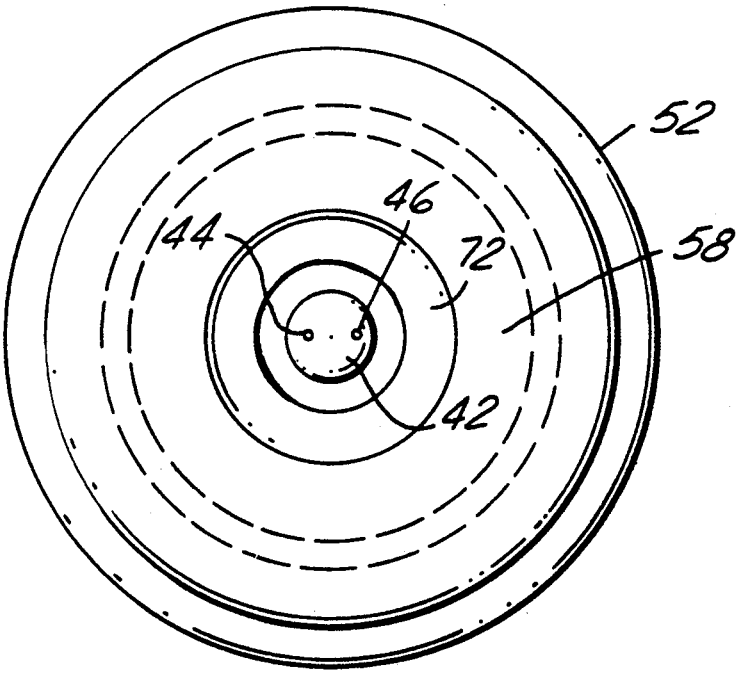
FIG. 3 is a full end view in the direction of arrows 3—3 in FIG. 2.
Figure 5:
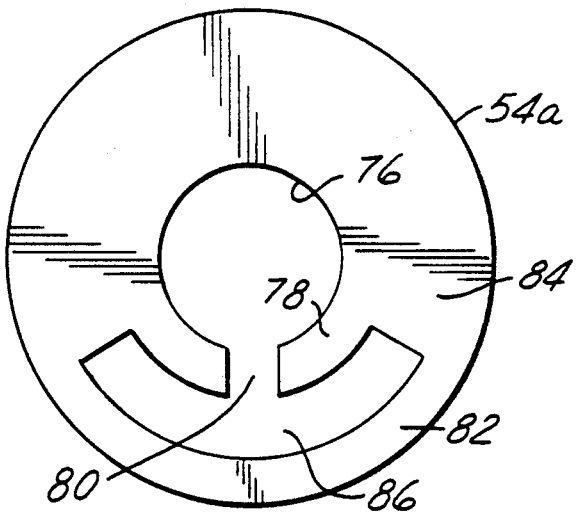
FIG. 5 is a plan view of the disk of FIG. 4.

FIG. 1–3 illustrate an electrically operated fuel injector 10 containing an air assist atomizer 12 embodying principles of the invention. Fuel injector 10 has a main longitudinal axis 14 and is a top-feed type device comprising an inlet 16 and a nozzle 18 at its opposite axial ends. The passage of liquid fuel through the fuel injector between inlet 16 and nozzle 18 is controlled by the seating and unseating of the rounded tip end of a metal needle 20 on and from a valve seat 22 located just interior of nozzle 18. Needle 20 is resiliently biased by a spring 24 to seat on seat 22 thereby closing the passage to flow. When the valve is electrically energized by the delivery of electric energizing current to its solenoid coil 26, the needle unseats to allow fuel flow. FIGS. 1 and 2 show the fuel injector closed.

The construction in the vicinity of nozzle 18 is shown in greater detail in FIG. 2. The fuel injector comprises a generally tubular metal housing 28 which contains in order of assembly at the nozzle end, a metal needle guide member 30, a metal valve seat member 32, a thin disk orifice member 34 made of metal, and a metal retainer member 36. An O-ring seal 40 is disposed between member 32 and the inside wall of housing 28. Thin disk orifice member 34 contains a central conical dimple 42 having exactly two orifices 44, 46 diametrically opposite each other equidistant from axis 14. When the fuel injector is operated open, the pressurized fuel that is supplied to the injector via inlet 16 is injected from nozzle 18 in two distinctly divergent directions represented generally by the respective numerals 48, 50 in FIG. 2. The construction of the injector and its nozzle end which has thus far been described is generally like that disclosed in certain commonly assigned issued patents, and therefore will not be described further at this time so that attention can be focused on the inventive features residing in air assist atomizer 12 and its association with fuel injector 10.

The air assist atomizer comprises two parts in assembly relation with the fuel injector: one part being a shroud 52 and the other being an insert 54. Shroud 52 possesses a general cap shape having a side wall 56 and an end wall 58. Side wall 56 has a circular cylindrical inside diameter including a shoulder 60 that divides it into a larger diameter portion 62 and a smaller diameter portion 64. Portion 64 extends from immediate contiguousness with end wall 58 to shoulder 60 while portion 62 extends from shoulder 60 to the end of shroud 52 that is opposite end wall 58.

A portion of housing 28 has a nominally circular outside diameter 66 that is dimensioned to allow portion 62 of shroud 52 to snuggly fit onto it. However, that nominally circular outside diameter 66 is provided with one or more interruptions, such as an axial flat or slot 68, so as to thereby cooperatively define with the shroud's side wall the entrance portion of axially extending passage means 70 for assist air to flow axially along the outside of housing 28 toward nozzle 18. The small arrows in FIG. 2 represent the assist air flow.

End wall 58 extends radially inwardly from side wall 56 to provide an axially frusto-conically expanding aperture 72 which is coaxial with axis 14 and through which fuel that has just been injected from nozzle 18 passes. A raised circular annular ledge 74 is fashioned on the inside of end wall 58 in circumscription of aperture 72. Insert 54 is disposed axially between nozzle 18 and end wall 58 and is in fact held between ledge 74 and the exterior axial end face of member 36.

Figure 4:
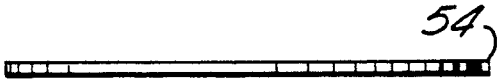
FIG. 4 is a side view in the radial direction of a disk that is used in the air assist atomizer.
Figure 6:
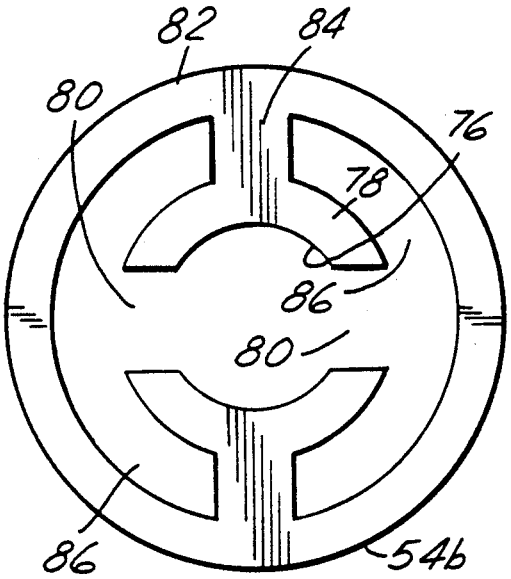
FIG. 6 is a plan view of a second embodiment of disk.
Figure 7:
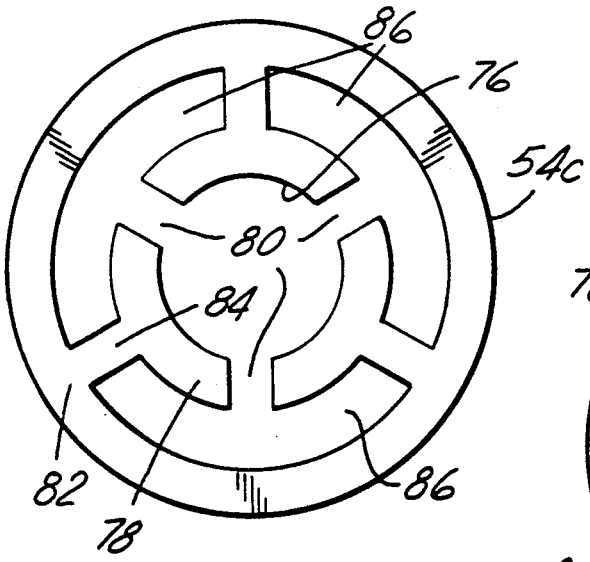
FIG. 7 is a plan view of a third embodiment of disk.
Figure 8:
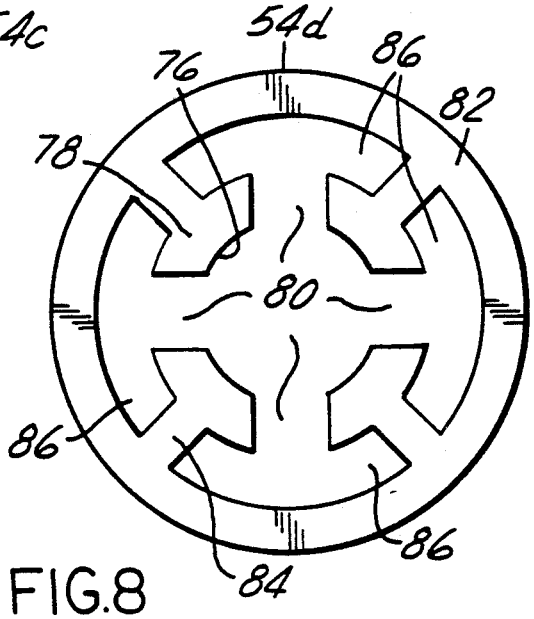
FIG. 8 is a plan view of a fourth embodiment of disk.

FIGS. 5–8 disclose four different embodiments of insert 54, and for convenience each of them is uniquely identified by including a particular literal suffix after the base numeral 54 such that the respective disks are **54*a*, 54*b*, 54*c*, and 54*d* for each of FIGS. 5–8 respectively. The view of FIG. 4 is equally applicable to all four embodiments and is designated by only the base numeral 54. While it is possible for any given insert to be used with a fuel injector having almost any type of thin disk orifice member, or equivalent, it is intended that either insert 54*b* or 54*d* be used in a fuel injector containing the particular thin disk orifice member 34 that has been described above; inserts 54*a* and 54*c*** are intended to be used with thin disk orifice members that have a single orifice at the center and no dimple.

Each insert 54 is in the form of a disk that is flat and of uniform thickness throughout. It comprises a central circular void 76 that is surrounded by a circular annulus 78 which contains at least one circumferential discontinuity 80. Annulus 78 is bounded in radially outwardly spaced relationship by a second circular annulus 82 which, as shown, is preferably circumferentially continuous. A third circular annulus 84 joins annuli 78 and 82 and comprises one or more circumferential discontinuities 86, each of which is contiguous with a corresponding discontinuity 80 of annulus 78 and has a circumferential extent greater than that of the corresponding discontinuity 80. Void 76, discontinuity 80, and discontinuity 86 are through-holes in the disk.

Insert **54*a* has a single discontinuity 80 and a single discontinuity 86; insert 54*b* has two and two; insert 54*c* has three and three; and insert 54*d* has four and four. Each discontinuity 80 is circumferentially centered with respect to its contiguous discontinuity 86, and in the case of inserts 54*b*, 54*c*, and 54*d*, the discontinuities 80 are of equal circumferential dimensions and are arranged in a uniform pattern such that each discontinuity 80** is equally circumferentially spaced from immediately adjacent ones.

The outside diameter (O.D.) of an insert 54 is dimensioned just slightly less than the inside diameter (I.D.) of side wall portion 64 to allow the insert to pass axially through the shroud so that it can be disposed against the inside of end wall 58 preparatory to assembling the atomizer to the fuel injector. In this way, annulus 82 functions as a locator to properly center, i.e. radially locate, the insert within the shroud. Such placement serves to dispose annulus 78 on ledge 74 so that when the insert-containing shroud is thereafter assembled onto the nozzle by advancing the shroud over the end of housing 28, annulus 78 will be sandwiched between and in mutual abutment with ledge 74 and the annular end surface of member 36, as appears in FIGS. 1 and 2.

Thus after assembly of the atomizer to the fuel injector, the sandwiched annulus 78 will in cooperation with the end surface of member 36 and ledge 74 define a number of air assist openings 88 (see FIG. 2) through which assist air passes radially inwardly toward fuel just injected from the nozzle. The axial dimension of each opening 88 is equal to the thickness of insert 54, and its circumferential extent is equal to the circumferential dimension of the corresponding discontinuity 80 in the insert. Assist air enters each opening 88 from the corresponding discontinuity 8 which is in communication with the inner downstream end of passage means 70.

The illustrated inserts 54 are advantageous in that they can be fabricated by stamping from sheet material. Because they are flat and of uniform thickness throughout, the inserts have an overall axial dimension that is equal to their thickness. While the illustrated inserts do not have express provision for securing circumferential registry with the corresponding shroud, an express means therefor could be incorporated if desired. Likewise, it is possible to secure proper circumferential registry without an express means therefor. In such case, the insert is properly circumferentially oriented on the shroud prior to assembling the shroud over the end of the nozzle. Such circumferential registry is important in the case of a fuel injector which has a thin disk orifice member like that illustrated in FIGS. 1 and 2. This is because it is deemed preferable to align diametrically opposite openings 88 on the common diameter between orifices 44 and 46.

The insert and shroud are fabricated from suitable materials, such as stainless steels. It is preferred that the covers between void 76 and discontinuities 80 be kept sharp while those between discontinuities 80 and 86 be radiused. The several parts of the fuel injector are fabricated from conventional parts and materials in known manner.

The atomizer-equipped fuel injector 10 is adapted to be installed in manifold (not shown) that delivers assist air to the open upstream end of passage means 70. Axially spaced apart O-rings 90, 92 on the outside of housing 28 and the outside of shroud 52 provide for sealing of the atomizer-equipped fuel injector to a socket in the manifold for receiving the injector.

In use, the air atomizer promotes the atomization of fuel being injected. In the case of the illustrated fuel injector, the injections along the directions 48, 50 will be nebulized by the atomizer into the shape of respective clouds, as distinguished from narrower streams. Of course, it should be understood that principles of the invention may be practiced in other than only the specifically disclosed examples.

What is claimed is:

1. An air-assisted fuel injector having a nozzle from which fuel is injected into an induction air system of an internal combustion engine and air assist means fitted onto said nozzle for directing assist air to flow axially along the outside of said nozzle and then radially inwardly toward injected fuel that has just left said nozzle to assist in atomizing the same, said air assist means comprising a shroud member that is disposed over said nozzle, that has a side wall cooperating with said nozzle to form axially extending passage means via which assist air passes axially along the outside of said nozzle, and that has an end wall extending radially inwardly from said side wall to form aperture means through which the injected fuel that has just left said nozzle passes, said air assist means further comprising a separate insert member disposed between said shroud and said nozzle characterized in that said insert member comprises a disk of uniform thickness comprising an annulus that is sandwiched axially between and in mutual abutment with both said end wall and said nozzle, and in that said annulus contains at least one circumferential discontinuity that cooperates with said end wall and said nozzle to form a corresponding at least one air assist opening through which radially inward flow of assist air passes toward the injected fuel that has just left said nozzle, said at least one air assist opening having an axial dimension that is equal to said thickness of said disk.

2. An air-assisted fuel injector as set forth in claim 1 in which said annulus is circular in shape.

3. An air-assisted fuel injector as set forth in claim 1 in which the entirety of said disk is flat and planar throughout such that the overall axial dimension of said disk is equal to its thickness.

4. An air-assisted fuel injector as set forth in claim in which said disk comprises a locating means disposed radially of said annulus and coacting with said shroud for radially locating said annulus.

5. An air-assisted fuel injector as set forth in claim 4 in which said locating means comprises a second annulus that is disposed radially outwardly of the first-mentioned annulus and that coacts with said side wall of said shroud for radially locating said first-mentioned annulus, and in which said disk further comprises a through-hole between said second annulus and said first-mentioned annulus via which assist air passes to said at least one air assist opening, said through-hole having a greater circumferential extent than said at least one air assist opening.

6. An air-assisted fuel injector as set forth in claim 5 in which said second annulus is circumferentially continuous.

7. An air-assisted fuel injector as set forth in claim 6 in which said second annulus and said first-mentioned annulus are both circular in shape and are disposed in a common plane.

8. An air-assisted fuel injector as set forth in claim 7 in which the entirety of said disk is flat and planar throughout such that the overall axial dimension of said disk is equal to its thickness.

9. An air-assisted fuel injector as set forth in claim 8 in which said first-mentioned annulus comprises plural such air assist openings arranged in a circumferentially uniform pattern wherein each such air assist opening is spaced circumferentially substantially equidistant from immediately adjacent ones.

10. An air-assisted fuel injector as set forth in claim 1 in which said end wall comprises an internal raised ledge against which said annulus abuts.

11. An air-assisted fuel injector as set forth in claim 10 in which said annulus comprises plural such air assist openings arranged in a circumferentially uniform pattern wherein each such air assist opening is spaced circumferentially substantially equidistant from immediately adjacent ones.

12. An air-assisted fuel injector as set forth in claim 11 in which said disk comprises a locating means disposed radially of said annulus and coacting with said shroud for radially locating said annulus.

13. An air-assisted fuel injector as set forth in claim 12 in which said locating means comprises a second annulus that is disposed radially outwardly of the first-mentioned annulus and that coacts with said side wall of said shroud for radially locating said first-mentioned annulus.

14. An air-assisted fuel injector as set forth in claim 13 in which said second annulus and said first-mentioned annulus are both circular in shape and are disposed in a common plane.

15. An air-assisted fuel injector as set forth in claim 1 in which said nozzle comprises means for injecting fuel from exactly two injection orifices that are diametrically opposite each other in said nozzle and that direct respective portions of the injected fuel in mutual divergence, said at least one air assist opening comprises exactly two such air assist openings that are diametrically opposite each other, and in which said two such injection orifices and said two such air assist openings lie on a common diameter when viewed axially of the nozzle.

16. An air-assisted fuel injector as set forth in claim 1 in which said nozzle comprises means for injecting fuel from exactly two injection orifices that are diametrically opposite each other in said nozzle and that direct respective portions of the injected fuel in mutual divergence, said at least one air assist opening comprises exactly four such air assist openings that are ninety degrees apart, and in which said two injection orifices and two diametrically opposite ones of said exactly four such air assist openings lie on a common diameter when viewed axially of the nozzle.

17. An air-assisted fuel injector as set forth in claim 1 in which at least a portion of the axial length of said side wall of said shroud member comprises a transverse cross section which has a nominally circular inside diameter, at least a portion of the axial length of said nozzle comprises a transverse cross section which has a nominally circular outside diameter, said at least a portion of the axial length of said side wall of said shroud member and said at least a portion of the axial length of said nozzle have their respective nominal inside and outside diameters snuggly fitted together, and said at least a portion of the axial length of said nozzle comprises one or more interruptions of its nominally circular outside diameter that cooperate with said at least a portion of the axial length of said side wall of said shroud member to define at least portion of said axially extending passage means.

18. An air-assisted fuel injector as set forth in claim 17 in which said at least a portion of the axial length of said side wall of said shroud member includes that axial portion of said side wall that is most distant from said end wall of said shroud member.

19. An air-assisted fuel injector having a nozzle from which fuel is injected into an induction air system of an internal combustion engine and air assist means fitted onto said nozzle for directing assist air to flow axially along the outside of said nozzle and then radially inwardly toward injected fuel that has just left said nozzle to assist in atomizing the same, said air assist means comprising a shroud member that is disposed over said nozzle, that has a side wall cooperating with said nozzle to form axially extending passage means via which assist air passes axially along the outside of said nozzle, and that has an end wall extending radially inwardly from said side wall to form aperture means through which the injected fuel that has just left said nozzle passes, said air assist means further comprising a separate insert member disposed between said shroud and said nozzle characterized in that said insert member comprises a disk comprising an annulus that is sandwiched in the direction of its thickness axially between and in mutual abutment with both said end wall and said nozzle, and in that said annulus contains at least one circumferential discontinuity that cooperates with said end wall and said nozzle to form a corresponding at least one air assist opening through which radially inward flow of assist air passes toward the injected fuel that has just left said nozzle, said at least one air assist opening having an axial dimension that is equal to the thickness of said annulus, and in which said disk comprises a locating means disposed radially of said annulus and coacting with said shroud for radially locating said annulus.

20. An air-assisted fuel injector as set forth in claim 19 in which said locating means comprises a second annulus that is disposed radially outwardly of the first-mentioned annulus and that coacts with said side wall of said shroud for radially locating said first-mentioned annulus.

21. An air-assisted fuel injector as set forth in claim 19 in which said disk has a uniform thickness throughout and is flat and planar throughout.

22. An insert that is used as part of an assist air atomizer that is disposed on the nozzle of a fuel injector, said insert being disposed between such a nozzle and a shroud of the atomizer and comprising a flat, planar, circular disc of uniform thickness throughout comprising a central circular void, a circular annulus surrounding said void and comprising at least one circumferential discontinuity, a second circular annulus surrounding the first-mentioned circular annulus in outwardly spaced relationship, and a third circular annulus that joins said first-mentioned annulus and said second annulus, said third circular annulus comprising at least one circumferential discontinuity that is contiguous with said at least one circumferential discontinuity of said first-mentioned circular annulus and that has a circumferential extent that exceeds the circumferential extent of said least one circumferential discontinuity of said first-mentioned annulus.

23. An air-assisted fuel injector having a nozzle from which fuel is injected into an induction air system of an internal combustion engine and air assist means fitted onto said nozzle for directing assist air to flow axially along the outside of said nozzle and then radially inwardly toward injected fuel that has just left said nozzle to assist in atomizing the same, said air assist means comprising a shroud member that is disposed over said nozzle and that has a side wall cooperating with said nozzle to form axially extending passage means via which assist air passes axially along the outside of said nozzle, at least a portion of the axial length of said side wall of said shroud member comprising a transverse cross section which has a nominally circular inside diameter, at least a portion of the axial length of said nozzle comprising a transverse cross section which ha a nominally circular outside diameter, said at least a portion of the axial length of said side wall of said shroud member and said at least a portion of the axial length of said nozzle having their respective nominal inside and outside diameters snuggly fitted together, and a separate insert member disposed between said nozzle and said shroud member and coacting therewith to channel assist air radially inwardly from said axially extending passage means toward injected fuel that has just left said nozzle, characterized in that said at least a portion of the axial length of said nozzle comprises one or more interruptions of its nominally circular outside diameter that cooperate with said at least a portion of the axial length of said side wall of said shroud member to define at least a portion of said axially extending passage means, and said separate insert member has a circumferentially continuous outer margin that fits closely within the nominally circular inside diameter of said shroud member so as to be radially located by said shroud member.

24. An air-assisted fuel injector as set forth in claim 23 in which said shroud member has an end wall extending radially inwardly from its side wall to form aperture means through which the injected fuel that has just left said nozzle passes, and in which said at least a portion of the axial length of said side wall of said shroud member includes that axial portion of said side wall that is most distant from said end wall of said shroud member.

* * * * *